US005678822A

United States Patent [19]

Setteducati

[11] Patent Number: 5,678,822

[45] Date of Patent: Oct. 21, 1997

[54] KINEOGRAPHIC PLAYING CARDS

[76] Inventor: Mark Setteducati, 218 E. 17 St., New York, N.Y. 10003

[21] Appl. No.: 667,709

[22] Filed: Jun. 21, 1996

[51] Int. Cl.[6] ..... A63F 1/00

[52] U.S. Cl. ..... 273/296; 352/99

[58] Field of Search ..... 273/296, 293, 273/298; 352/99

[56] References Cited

U.S. PATENT DOCUMENTS

| | | | |
|---|---|---|---|
| 1,787,592 | 1/1931 | Owens | 352/99 |
| 3,159,405 | 12/1964 | Brambier | 273/296 |
| 3,453,746 | 7/1969 | Cartwright | 273/298 |

OTHER PUBLICATIONS

"Paper Movie Machines" Authored by Budd Wentz Published 1975 By Troubadour Press S.F. pp. 17, 18, 31 & 32. Marked Cards, Scarne's Encyclopedia Of Games by John Scarne, Harper & Row Publishers, pp. 434–437. Dec. 1973.

*Primary Examiner*—Benjamin H. Layno

*Attorney, Agent, or Firm*—Robert W. J. Usher

[57] ABSTRACT

A deck of cards having front faces carrying indicia of playing values to and identical back faces each having a first end portion marked with a first image and a second, opposite end portion marked with a second image which is complementary to the first image and inverted relative to the first image so that so that the first and second images of overlying first and second end portions of different cards are aligned in the deck to provide an animated or kinematic effect when the deck is flipped. Front faces of each cards can also have first end and second end portions marked with complementary first and second images, respectively, to provide a kinematic image effect when the cards are flipped. At least three different, complementary images can be provided on respective front faces of different cards to form sequences of reciprocal actions so that exposure in any order when the cards are flipped provides a kinematic effect.

10 Claims, 3 Drawing Sheets

KINEOGRAPHIC PLAYING CARDS

FIELD OF THE INVENTION

The invention relates to a deck of kineographic playing cards and to an advertising device utilizing using such cards.

BACKGROUND OF THE INVENTION

The phenomenon of persistence of image which can result in kinematic and compound image or image transformation when complementary images are exposed in rapid succession to a spectator have been known for more than 150 years. Examples of applications of such effect are disclosed in "Paper Movie Machines" by Budd Wentz, published in 1975 by the Troubador Press, San Francisco.

One widely used application taught in the above-noted publication on page 18 is a "Flip book" or kineograph in which cards having faces carrying images in different positions are bound along one edge or otherwise permanently secured together in a stack so that the cards may be "flipped" to expose their faces in rapid succession providing animation such as a moving image. Another example, (on page 17), employing only two complementary images is a rolling pencil "Flip-it" which provides a kinematic effect.

It is desirable to provide a deck of kineographic cards which are not bound together so that they can be used for a wide variety of card games, but placing a series of different images on the backs of cards in known fashion would spoil those games as experienced players would remember the values of the front faces of the corresponding cards providing an unacceptable advantage.

Similarly, placing a series (at least three) conventional images in progressively differing positions on the card faces would normally be ineffective in providing the kinematic effect, when the cards were shuffled.

SUMMARY OF THE INVENTION

It is an object of the invention to provide a deck of cards having identical images on back faces so that the values of the front faces cannot be determined but which images are so constituted and arranged that flipping the cards exposing successive back faces provides an animated or kinematic effect.

It is another object of the invention to provide a deck of playing cards which can, irrespective of the sequence of the cards exposed, within limits, be flipped to provide an animated effect, thereby enabling the deck to be shuffled freely without destruction of the animation effect.

According to one aspect of the invention, there is provided a deck of playing cards having front faces carrying different indicia representing different playing values and identical back faces each having a first end portion marked with a first image and a second, opposite end portion marked with a second image which is complementary to the first image so that flipping the deck of cards to expose overlying first and second back end portions provides an animated or kinematic image effect.

In one example, the first image is inverted relative to the second image image so that the first and second images of overlying first and second end portions of different cards are aligned in the deck to provide an animated or kinematic effect when flipped.

The front faces of the cards may each have a first end portion marked with a first image and a second, opposite end portion marked with a second image which is complementary to the first image so that flipping the deck of cards to expose overlying first and second, front end portions provides an animated or kinematic image effect.

If, occasionally, a first end portion does not overlie a second end portion of an adjacent card so that identical images are exposed in immediate succession to a spectator when the cards are flipped, the overall kinematic illusion is not destroyed but a change of pace or speed of movement results which can enhance the variety of movement and amusing effect.

More than two different, complementary images may be provided on respective cards which form sequences of reciprocal actions so that images may be exposed in any order when the cards are flipped to provide the kinematic or motion effect.

It will be appreciated that cards may have identical back faces with inverted complementary images as described above and front faces with different complementary images which form sequences of reciprocal actions.

In another version, the sequences of complementary card images necessary to produce a kinematic effect are obtained only when specific goals are achieved according to the rules of the card game such as a meld in canaster or the accumulation and identification of groups of cards having the complementary images necessary to form a sequence producing a kinematic effect may itself form one object or goal of the game.

BRIEF DESCRIPTION OF THE DRAWINGS

Embodiments of the invention will now be described by way of example only and with reference to the accompanying drawings in which.

DESCRIPTION OF PARTICULAR EMBODIMENTS

Figure 1A:
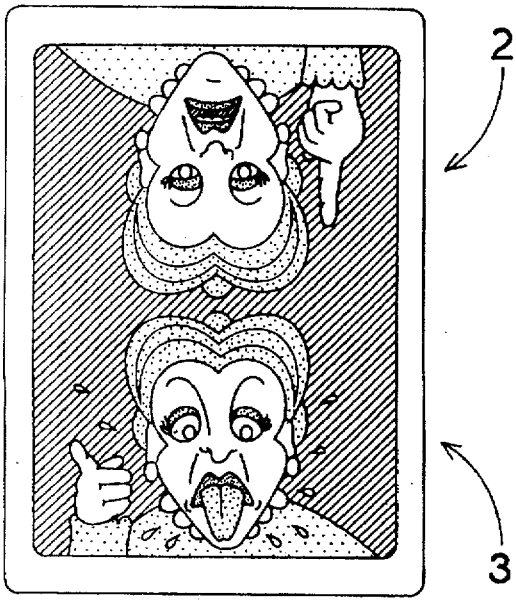
FIGS. 1A and 1B are plan views of back faces of respective identical conventional playing cards according to a first embodiment, shown inverted relatve to each other for ease of understanding.
Figure 1B:
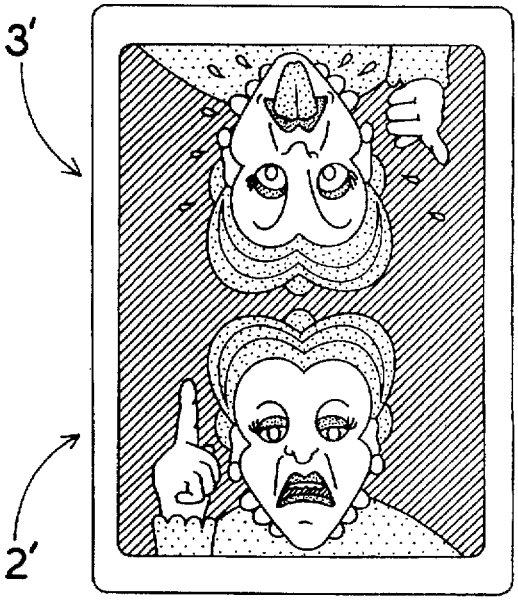
Figure 3:
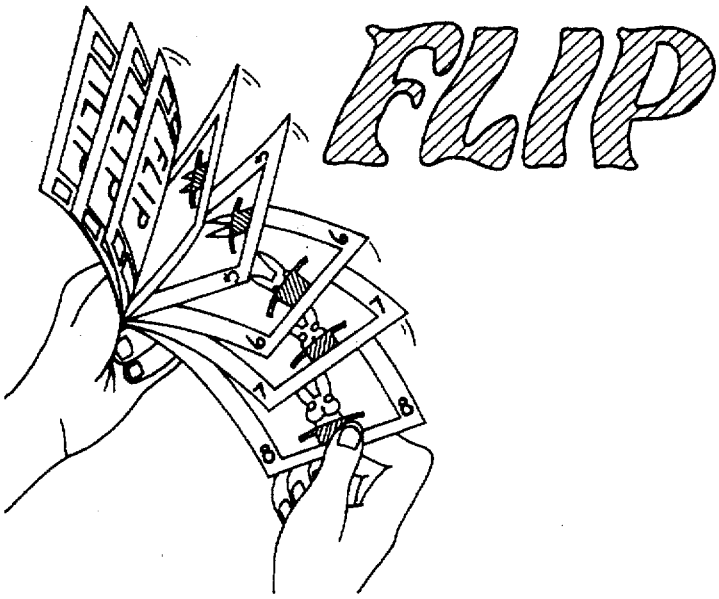
FIG. 3 illustrates a typical flipping action.

The playing cards shown in FIGS. 1A and 1B have front faces (not shown) carrying conventional playing card indicia and back faces having first and second, opposite, end portions 2 and 2', respectively, printed with first and second, inverted, complementary images 3 and 3' which depict the same character in different gesturing positions,(e.g. Old Maid chastising the loser of the game).

Thus, although the back faces are indistinguishable from each other and cannot be correlated with a value on the front face, when the deck is flipped to expose overlying end different end portions more or less successively, the character's finger and tongue will appear to move. The directions and speeds of movement will of course depend on the precise sequence of presentation resulting from a shuffle of the deck.

For example, when a first end portion of a card does not overlie an adjacent second end portion of the next card but another, identical, first end portion, there will be a pause in movement when those two cards are flipped. Otherwise the movement will be reciprocal with the tongue moving in and out and the finger wagging back and forth. As indicated above, the rate of movement will depend on the number of repetitions of successively overlying same end portions and will vary according to the shuffle.

Figure 2C:
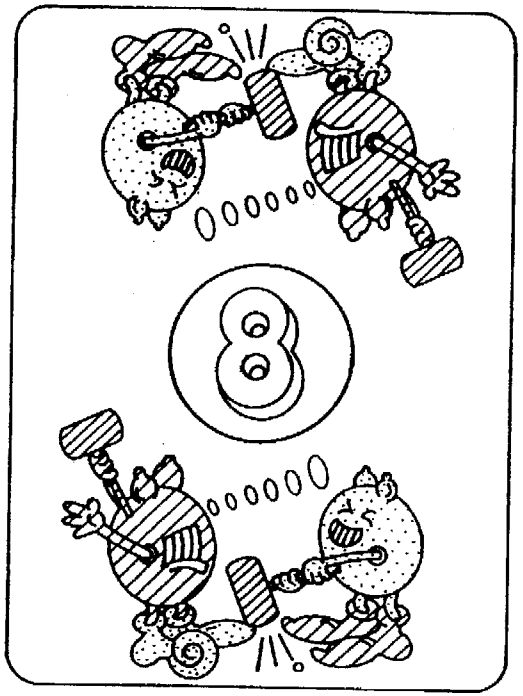
FIGS. 2A–2C are plan views of front faces of playing cards according to a second embodiment.
Figure 2B:
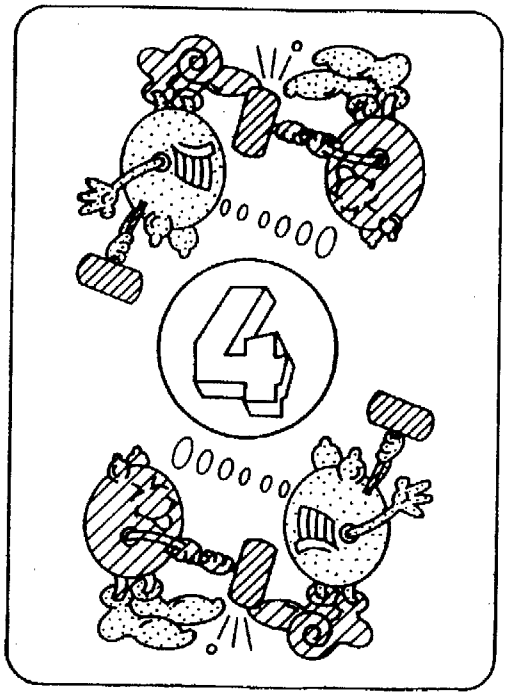
Figure 2A:
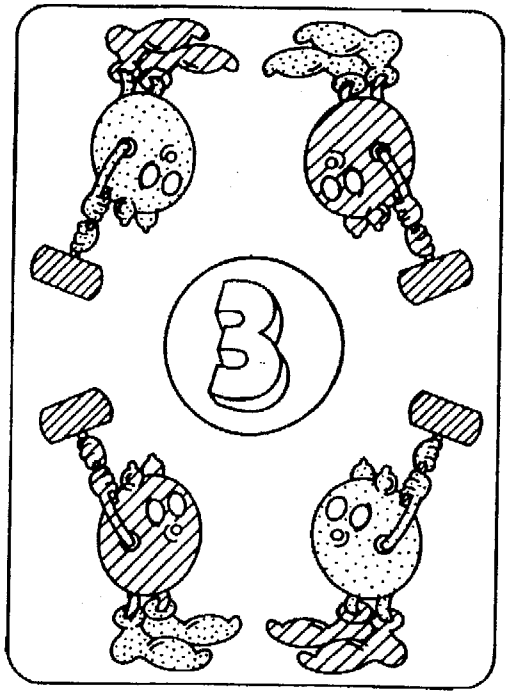
Figure 4A:
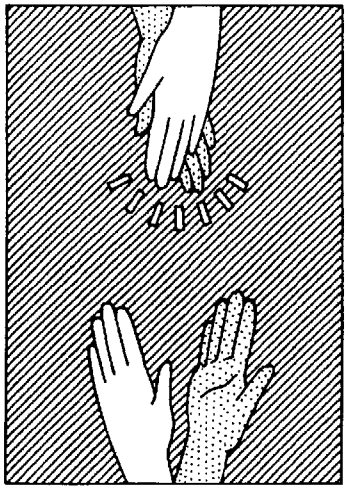
FIGS. 4A and 4B are plan views of back faces of respective identical conventional playing cards according to a third embodiment, shown inverted relatve to each other.
Figure 5A:
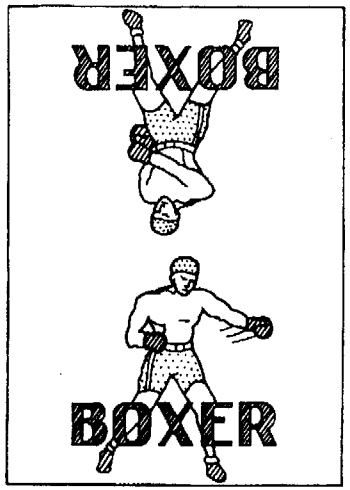
FIGS. 5A and 5B are plan views of back faces of respective identical conventional playing cards according to a fourth embodiment, shown inverted relatve to each other.
Figure 6A:
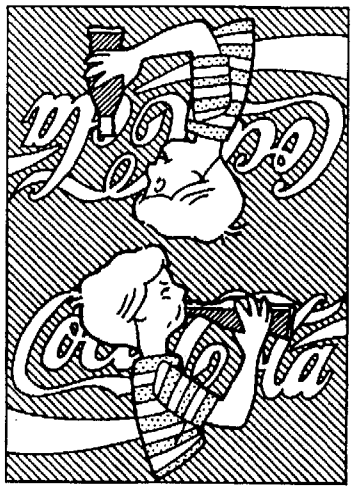
FIGS. 6A and 6B are plan views of back faces of respective identical conventional playing cards according to a fifth embodiment, shown inverted relatve to each other.
Figure 4B:
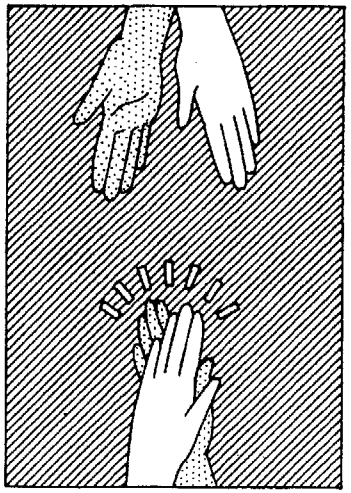
Figure 5B:
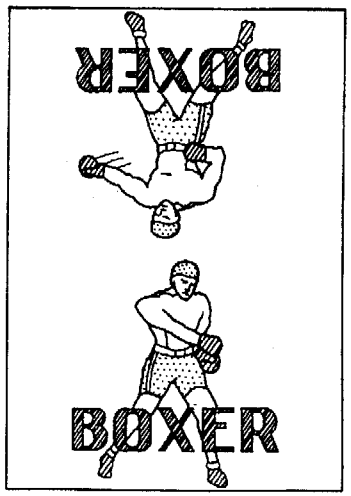
Figure 6B:
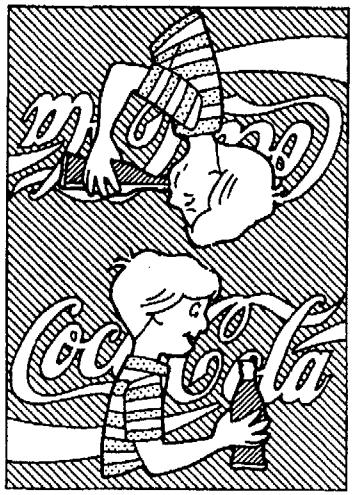

In the second embodiment shown in FIGS. 2A–2C, the front faces of different cards have the same characters depicted thereon but the positions of the characters differ from card to card to provide complementary images on respective different cards so that when the cards are flipped a kinematic effect is obtained. It should be particular noted that although there are three different images the order of exposure is not important as the images form gestures which form sequences (or snap-shots) of reciprocal actions permitting the cards to be shuffled freely. A greater variety of types and speeds of movement can be obtained than with the first embodiment enhancing the amusement value to spectators.

The characters are fighting figures from the game of War. The winner picks up the deck and flips the cards won to reveal animated characters hitting each other affording additional amusement and impact to the traditional game.

The minimum number of cards needing to be flipped to provide the effect is usually six or more.

A fourth card could be added showing the same characters in different positions provided the image on the fourth card was complementary to the other three images in showing a possible sequence of movement.

The cards could provide advertising/promotional devices for example the images could show a character lifting a jug of beer to his mouth with the logo of the brewer or distributer marked thereon.

The images on the end portion of the same card need not be identical but could themselves be complementary in a similar manner to the first embodiment.

In one embodiment, the logo or jug could be marked in different positions on different cards.

The third, fourth and fifth embodiments shown in FIGS. 4A and 4B, 5A and 5B, 6A and 6B, repectively, illustrate hands which clap when the cards are flipped, boxers which punch and, a boy raising and lowering a bottle of cola to swig therefrom, respectively. The irregular presentation caused by shuffling creates pauses which give the perception of the boy both actually taking the time to drink the cola and resting between drinking.

I claim:

1. A deck of cards having front faces carrying different indicia representing different playing values according to rules of a game and identical back faces each having a first end portion marked with a first image and a second, opposite end portion marked with a second image which is complementary to the first image so that flipping the deck of cards to expose overlying first and second back end portions causes the first and second images to combine together by a persistence of image effect to provide an animated or kinematic image.

2. A deck of cards according to claim 1 wherein the first image is inverted relative to the second image so that the first and second images of overlying first and second end portions of different cards are aligned in the deck to provide the animated or kinematic effect when flipped.

3. A deck of cards according to claim 2 having front faces each having a first end portion marked with a first image and a second, opposite end portion marked with a second image which is complementary to the first image so that flipping the deck of cards to expose overlying first and second front end portions causes the first and second images to combine together by a persistence of image effect to provide an animated or kinematic image effect.

4. A deck of cards according to claim 3 in which at least three further, complementary images are provided on respective front faces of different individual cards which further, complementary images form sequences of reciprocal actions so that said further, complementary images on said from faces may be exposed in any order when the cards are flipped to combine together by a persistence of image effect to provide a kinematic effect.

5. A deck of cards according to claim 2 in which at least three further, complementary images are provided on respective front faces of different individual cards which further, complementary images form sequences of reciprocal actions so that said further, complementary images on said front faces may be exposed in any order when the cards are flipped to combine together by a persistence of image effect to provide a kinematic effect.

6. A deck of cards according to claim 5 wherein the further individual images are marked on first and second opposite end portions of respective front faces so that the further image on the first end portion is inverted relative to the further image on the second end portion.

7. A deck of cards according to claim 6 wherein the further individual images are marked on first and second opposite end portions of respective front faces so that the further image on the first end portion is inverted relative to the further image on the second end portion.

8. A deck of cards according to claim 1 in which at least three further, complementary images are provided on respective front faces of different individual cards which further, complementary images form sequences of reciprocal actions so that said further, complementary images on said front faces may be exposed in any order when the cards are flipped to combine together by a persistence of image effect to provide a kinematic effect.

9. A deck of cards according to claim 8 wherein the further individual images are marked on first and second opposite end portions of respective front faces so that the further image on the first end portion is inverted relative to the further image on the second end portion.

10. A deck of cards in which at least three different, complementary images are provided on respective front faces of different individual cards which different, complementary images form sequences of reciprocal actions so that said different, complementary images may be exposed in any order when the cards are flipped to combine together by a persistence of image effect to provide a kinematic effect wherein individual images are marked on first and second opposite end portions of erspective front faces so that the images on the first end portion is inverted relative to the image on the second end portion.

* * * * *